United States Patent [19]

Heyde et al.

[11] Patent Number: 4,618,753

[45] Date of Patent: Oct. 21, 1986

[54] INSULATING CHAMBER

[75] Inventors: Hans H. Heyde, Itajai-SC; Julio A. Echeverria, São Paulo-SP, both of Brazil

[73] Assignee: Lorenzetti-Inebrasa S/A., Itajai-Santa Catarina, Brazil

[21] Appl. No.: 679,017

[22] Filed: Dec. 6, 1984

[51] Int. Cl.[4] ..... H01H 33/56

[52] U.S. Cl. ..... 200/148 G; 200/144 R; 200/148 H; 200/150 C

[58] Field of Search ..... 200/150 C, 148 H, 144 R, 200/148 G

[56] References Cited

U.S. PATENT DOCUMENTS 4,357,508 11/1982 Werner ..... 200/150 C

FOREIGN PATENT DOCUMENTS 208007 5/1957 Australia ..... 200/150 G

*Primary Examiner*—Robert S. Macon

*Attorney, Agent, or Firm*—Michael J. Striker

[57] ABSTRACT

This invention deals with a new chamber meant to be used in insulating operation shafts or rods, with a view to disconnect electric switches, connect them again, or, besides, to act as contactors, so as to extinguish the electric are formed during the operation, specially in medium and high voltage overhead lines. In its general lines, the innovation consists in a chamber for breaking and/or re-connecting of section switches quencher of electric arc formed by an insulated body in the interior of which there is arranged an actuating movable contact in one or two fixed contacts, this movable contact being driven by a shaft provided in the chamber and tripped by a spring assembly provided in an appropriate mechanism, said chamber being closed and sealed, containing in its interior sulfur hexafluoride gas (SF6) under pressure.

12 Claims, 2 Drawing Figures

INSULATING CHAMBER

BACKGROUND OF THE INVENTION

This invention deals with a new chamber intended to be used with insulating shafts or rods, with a view toward connecting and disconnecting electric switches, so as to extinguish the electric arc formed during operation, especially in medium and high voltage overhead lines.

As is widely known in the art, the use of a portable device, known as a "Load Booster", is getting more and more popular in opening single-pole section switches in medium and high tension overhead lines.

These switches, normally installed without chambers or other devices for quenching the electric arc, may need to be opened without first shutting off the current. To make this possible, portable manual devices are used with electric arc break chambers placed at the end of operation in insulating rods.

SUMMARY OF THE INVENTION

It is an object of this invention to improve considerably the behaviour of these devices, as this new chamber for the portable device of the single-pole section switch opening operation under medium and high voltage load permits a larger number of operations under full load and a longer life, reducing the maintenance to a minimum. It is a further object to reduce cost and make handling easy by reducing size and weight. Generally, the invention consists of a chamber for breaking and/or reconnecting section switches, the chamber being formed by an insulated body in the interior of which there is arranged at least one movable contact and one fixed contact, this movable contact being driven by a shaft provided in the chamber and tripped by a spring assembly provided in an appropriate mechanism, said chamber being closed and sealed and containing in its interior sulfur hexafluoride gas (SF6) under pressure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
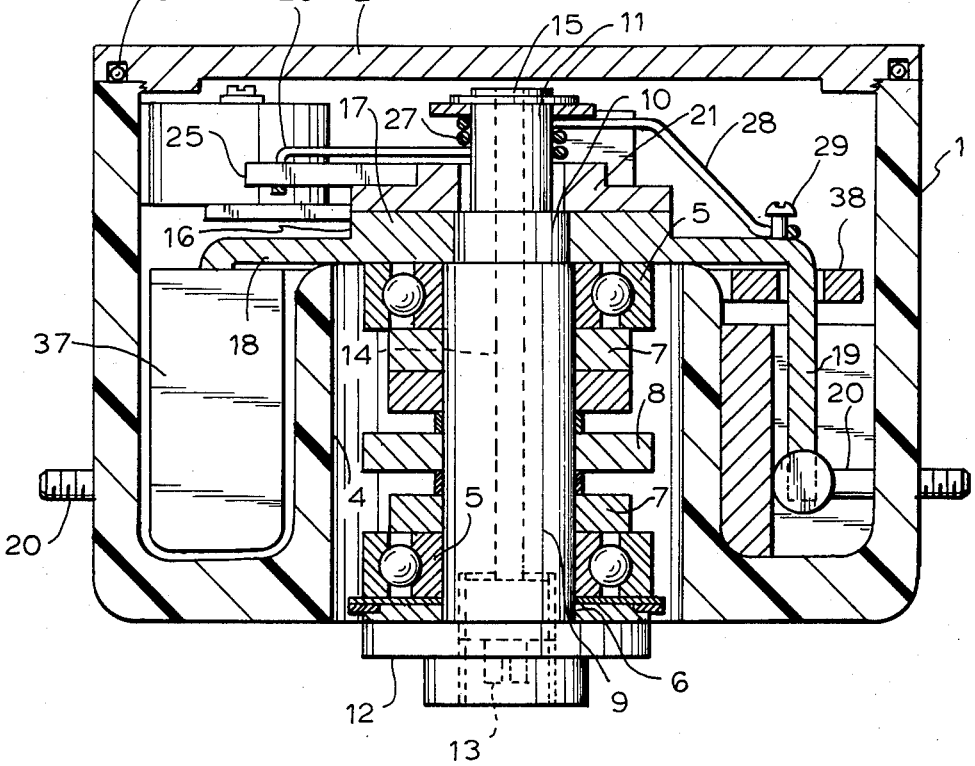
FIG. 1 shows a sectional view of the chamber along line AA, indicated in FIG. 2.
Figure 2:
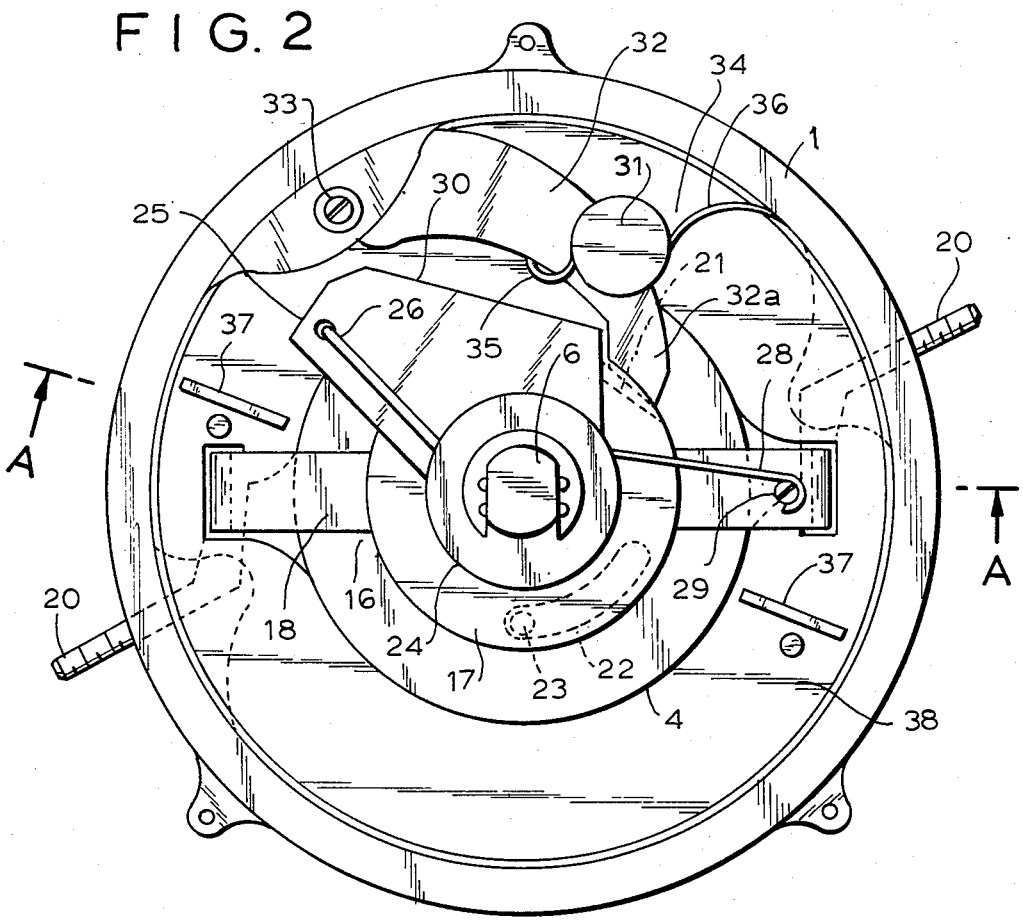
FIG. 2 is a plan view of the chamber without the upper cover.

A chamber according to the invention includes a cylindrical, insulating casing 1, having an open top, where it receives a threaded cover 2 united to a sealing ring 3 and a bottom from which a centrally disposed inner tubular projection extends upwardly and receives a pair of roller bearings 5 mounted on a shaft 6, and held in place with retainers 7 between which is provided an oil holder compartment 8.

A shaft portion 9 is arranged within the projection 4 and extends over most of the length of the shaft. Above portion 9 is a shaft portion 10 of a lesser diameter followed by a third portion 11 of a slightly lesser diameter than portion 10. At the opposite end of the shaft 6 there is provided a flange 12 on which there is mounted a valve 13 connected to a central conduit 14 which communicates with the upper end 15 of the shaft 6.

A movable contact 16 is made up of a disk 17 having a pair of equally spaced arms 18 the ends of which are turned downwards at extensions 19. The movable contact 16 is mounted on portion 11 of the shaft 6 by means of a central passage provided in the disk 17. The contact portions 19 are arranged to cooperate with fixed contacts 20 which pass through the casing 1. The disk 17 has on its side a groove 21 and has on its lower surface a curved guide 22 which receives a pin 23 mounted in the casing 1.

The movable contact 16 may be provided with one arm 18 only and with one fixed contact 20, the second contact being made directly with the shaft 6 by means of sliding contact between the shaft and disk portion 17 of the movable contact 16.

The third portion 11 of the shaft 6 is received through a hole in a ring portion 24 of a pulling plate 25. A helical spring has a central helical portion 27 received around third portion 11 of the shaft 6. One end 26 of the spring is secured to plate 25 and the other end 28 is secured to a pin 29 provided on one of the arms 18 of the movable contact 16. The pulling plate 25 has a sloping side 30 arranged to act on a pin 31 which is mounted on an arm 32 linked to a pivot shaft 33 provided in the casing 1. Pin 31 is enveloped by a helical spring 35 one end of which is secured to arm 32 and the other end 36 of which engages the inner wall of the casing 1. The arm contains at its free end a pawl or trigger **32*a* which engages groove 21 of disk 17**.

The movable contact 16 may solidly engage vertical plates 37 provided in the gap between the casing 1 and the inner tubular projection 4. A horizontal generally annular insulating plate 38, may also be provided around the projection 4.

The chamber is filled completely with sulfur hexafluoride ride gas (SF6), kept airtight and under internal pressure.

With this construction, the new chamber operates in a sure and efficient manner to break the circuit in section switches, when this should be necessary, without interrupting previously the electric surrent.

As in medium and high voltages, an undesirable electric arc occurs when the current is interrupted, and the new chamber quenches this electric arc in a quick and safe manner.

To achieve a quick quenching of the electric arc the new chamber provides two features: firstly, the quick withdrawal of one or two movable contacts from one or two fixed contacts and secondly providing the sulfur hexafluoride gas under pressure at the location in which the electric are occurs. At the moment of the quick displacement of the movable contact from the fixed contact, due to the quick movement of the vertical plate 37, there simultaneously occurs the gas blast in the electric arc area, increasing the efficiency of same.

The operation of the new chamber is made so as to initially load or set up the spring 27, when the movable contact 16 is turned through the shaft 6 to get in contact with the fixed contacts 20, the spring 27 being in this operation tensioned.

During the current break operation, the shaft rotates in the opposite direction, so that the pulling plate 25 moves in a manner which causes its side 30 to act on the pin 31, removing the trigger 32*a* from the groove 21 provided on the disk 17. This releases the disk 17 and under the action of the tensioned spring 27 the movable contact 16 and the plates 37 are quickly displace, causing the interruption of the current passage and the quenching of the electric arc. The pin 23 serves to limit rotation of disk 17.

The plates 38 are optional in the assembly, their use being necessary in case of high tension application, where more electric insulating power is called for. The plates are arranged in such a manner that the contacts are cut off one from the other, thereby increasing the insulation level of the assembly.

While the invention has been illustrated and described as embodied, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An insulating chamber for connecting and disconnecting electric switches in medium and high voltage overhead lines so as to quench any electric arc formed, comprising:

a closed and sealed casing containing pressurized sulfur hexafluoride gas for quenching the arc;

at least one fixed contact;

a rotatable shaft provided in said casing and having a length and lower and upper ends;

at least one movable contact rotatably driven by said shaft for engaging said fixed contact; and spring means engaging said shaft for rotatably driving said shaft so that said movable contact engages said fixed contact, said rotatable shaft having a first shaft portion beginning at said lower end and extending along a majority of said length for mounting said shaft, a second shaft portion extending above and having a diameter smaller than said first shaft portion for mounting said movable contact, and a third shaft portion extending from said second shaft portion to said upper end of said shaft.

2. An insulating chamber as defined in claim 1, wherein said casing has an open top which is closed by a removably mounted cover having sealing means to maintain pressurization.

3. An insulating chamber as defined in claim 2, wherein said cover is removably mounted by way of an internal thread formed in said casing near the open top which engages with an external thread formed in said cover.

4. An insulating chamber as defined in claim 3, wherein said sealing means is a sealing ring located between said cover and said casing.

5. An insulating chamber as defined in claim 1, wherein said casing has a bottom a centrally disposed inner tubular projection extending upwardly from its bottom; a pair of roller bearings for mounting said first portion of said rotatable shaft inside said tubular projection; retainers for holding said roller bearings in place; and an oil holder compartment provided between said retainers for lubrication.

6. An insulating chamber as defined in claim 1, wherein said movable contact includes a centrally passaged disk mounted on said second shaft portion for rotation therewith, said disk having a side with a groove therein and having a lower surface with a curved guide therein and also having at least one arm extending from said disk, said arm having an outward end and a downwardly turned extension at said outward end to engage said fixed contact; and further comprising:

a pin mounted in said casing and engagable in said curved guide of said disk so as to limit rotation of said disk.

7. An insulating chamber as defined in claim 6, wherein said disk has a pair of equally spaced arms.

8. An insulating chamber as defined in claim 6, wherein said spring means includes a pivot arm having two pivot ends with one of said pivot ends pivotably connected to said casing, and the other pivot end provided with a pawl for engaging said groove of said disk, a pulling plate having a ring portion for receiving said third shaft portion, said plate having a sloping side arranged to act on said pivot arm, a helical spring provided on said pivot arm and having two extended ends with one of said extended ends secured to said pivot arm and the other extended end connected to said casing to furnish said pivot arm with spring action, and a loaded helical spring having two spring ends and a central helical portion which receives said third shaft portion and rests above said pulling plate, one of said spring ends being secured to said pulling plate, and the other spring end being secured to one arm so that said loaded spring rapidly urges said arm to move said movable contact away from said fixed contact.

9. An insulating chamber as defined in claim 5; and further comprising vertical plates provided in the gap between said casing and said inner tubular projection so as to provide a blast of pressurized gas in the area of the electric arc.

10. An insulating chamber as defined in claim 9, wherein said movable contact is attached to said vertical plates.

11. An insulating chamber as defined in claim 5; and further comprising a horizontal generally annular insulating plate situated around said inner tubular projection and arranged in such a manner that the contacts are separated from each other.

12. An insulating chamber as defined in claim 1, wherein said shaft has a flange formed on said lower end and has central conduit running through its entire length; and further comprising a valve mounted on said flange and connected to said conduit for pressurizing said casing.

* * * * *